United States Patent [19]

Lifka et al.

[11] Patent Number: 4,659,396

[45] Date of Patent: Apr. 21, 1987

[54] METAL WORKING METHOD

[75] Inventors: Bernard W. Lifka, New Kensington; John Liu, Lower Burrell; Roger D. Doherty, Wynnewood, all of Pa.

[73] Assignee: Aluminum Company of America, Pittsburgh, Pa.

[21] Appl. No.: 636,134

[22] Filed: Jul. 30, 1984

[51] Int. Cl.[4] ..... C22F 1/04

[52] U.S. Cl. ..... 148/11.5 A; 148/12.7 A; 148/415; 148/416; 148/417; 148/438; 148/439; 148/440

[58] Field of Search ..... 148/11.5 A, 12.7 A, 148/2, 415, 416, 417, 418, 437-440

[56] References Cited

U.S. PATENT DOCUMENTS

| | | | |
|---|---|---|---|
| 3,113,052 | 12/1963 | Schneck | 148/11.5 A |
| 3,847,681 | 11/1974 | Waldman et al. | 148/11.5 A |
| 4,092,181 | 5/1978 | Paton et al. | 148/12.7 A |
| 4,222,797 | 9/1980 | Hamilton et al. | 148/12.7 A |
| 4,295,901 | 10/1981 | Robertson et al. | 148/12.7 A |
| 4,358,324 | 11/1982 | Mahoney et al. | 148/12.7 A |

*Primary Examiner*—R. Dean

*Attorney, Agent, or Firm*—Daniel A. Sullivan, Jr.

[57] ABSTRACT

A method including providing aluminum having particles for stimulating nucleation of new grains, and deforming the aluminum under conditions for causing recrystallization to occur during deformation or thereafter, without subsequent heating being required to effect recrystallization.

21 Claims, 8 Drawing Figures

100 um 100 um 500 um 500 um 500 um 500 um

METAL WORKING METHOD

BACKGROUND OF THE INVENTION

U.S. Pat. No. 3,113,052 in the name of Kenneth H. Schneck discloses a method for producing extrusions of aluminum-magnesium silicide alloy. An unrecrystallized, precipitation hardened product is obtained, having uniform strength and elongation properties.

It is also known to produce precipitation hardened aluminum alloy 6061 cylinders of high strength and good bendability by cold drawing subsequent to extrusion. The strain introduced into the metal by the cold working nucleates more grains and hence gives a finer overall grain size when recrystallization occurs during the solution heat treat.

U.S. Pat. No. 3,847,681 refers to a coarse precipitate structure, followed by deformation to introduce strain energy, followed by heating to effect fine-grained recrystallization.

SUMMARY OF THE INVENTION

It is an object of the invention to provide a new method for obtaining a fine grain recrystallized microstructure in aluminum.

Another object of the invention is to provide a new process for producing aluminum wrought products, particularly extruded products, i.e. rod, bar, shapes, tube of various cross sections, and pipe, of high strength and forming characteristics.

These as well as other objects, which will become apparent in the discussion that follows, are achieved, according to the present invention, by a method including providing aluminum having particles for stimulating nucleation of new grains, and deforming the aluminum under conditions for causing recrystallization to occur during deformation or thereafter, without subsequent heating being required to effect recrystallization.

DESCRIPTION OF THE PREFERRED EMBODIMENTS

Figure 1:
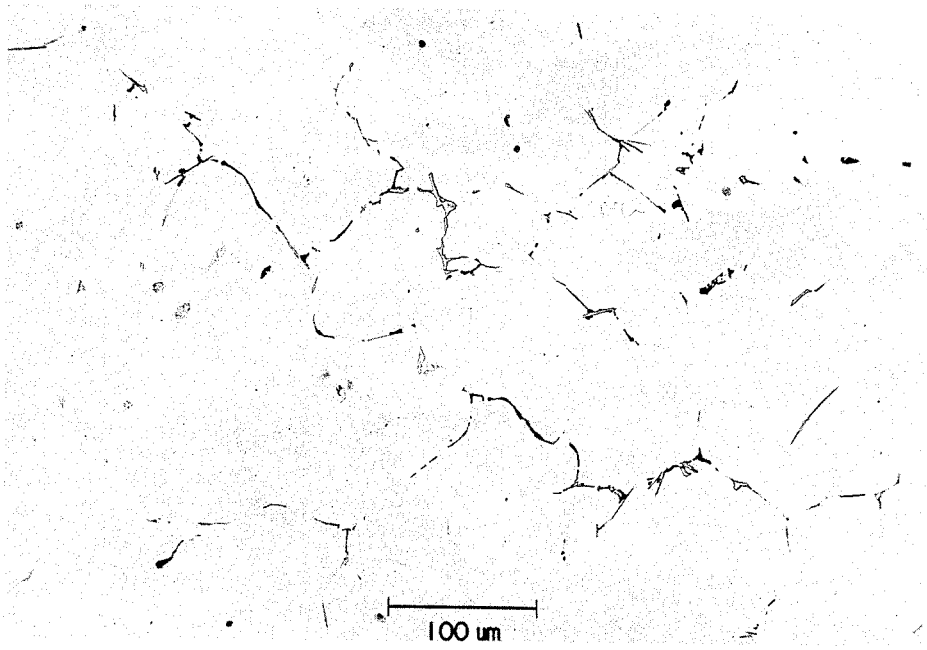
FIGS. 1 to 8 are photomicrographs of various aluminum alloy 6061 structures corresponding to different time-temperature histories. The symbol "$\mu$m" stands for "micrometers".

Various material properties, such as formability and bendability, are enhanced by a fine grained, recrystallized microstructure, as opposed to a coarse grained, recrystallized microstructure.

Researchers attempting to develop very fine grain sizes in cold rolled sheet have improved upon the effects that can be obtained solely from cold working by thermally treating the sheet so that it contains second-phase particles of an optimum size, typically 1 to 5 micrometers. These particles provide additional sites to nucleate grains during recrystallization, hence the name: particle stimulated nucleation (PSN).

The higher strength Al-Mg-Si 6XXX alloys typically contain one or more dispersoid forming elements, such as Mn, Cr or Zr, with a total concentration on the order of 0.3 to 0.9 wt-%. These elements form many, small particles, less than 1 micrometer in size, which tend to suppress recrystallization.

In the present invention, the chemical composition of the 6XXX alloy is adjusted to favor recrystallization in the absence of subsequent heating by controlling the total content of dispersoid forming elements below 0.15 wt-%, preferably below 0.10%. Such 6XXX ingots are preheated at temperatures above the solvus temperature of the respective alloy so that all the soluble Mg, Si and Cu alloying additions are dissolved. The ingot then is cooled rapidly enough from the preheat temperature to a temperature below the solvus to produce a supersaturated condition. Holding at this lower temperature then precipitates the $Mg_2Si$ phase and large particles are grown to act as nucleation sites for recrystallization during the deformation process, or thereafter, without subsequent heating being required to effect recrystallization. The reheat and deformation temperatures used should be sufficiently below the solvus temperature to avoid dissolution of the large $Mg_2Si$ particles. The net effect of minimizing dispersoids and forming nucleation particles stimulates more numerous recrystallized grains and an overall, smaller grain size in the deformed part.

Subsequent processing, e.g. solution heat treatment, quenching, straightening or stress relieval, and precipitation hardening (artificial aging) are carried out by conventional practices. During solution heat treatment the large $Mg_2Si$ particles are dissolved. Thus in the final temper, extrusions produced according to this invention are distinguishable from conventionally processed extrusions only by their finer grain size and by enhancement of certain material characteristics, such as bendability and formability.

The following examples are illustrative of the invention as applied to precipitate hardening aluminum alloys.

EXAMPLE 1

Aluminum Alloy 6061-T6

Aluminum 6061-T6 cylinders for compressed gases are produced from seamless extruded tube. Specifications require such tube to have both high strength and a high degree of bendability. For tube with a recrystallized grain structure, the bending requirement was met consistently only when the grain size was 50 or more grains/sq.mm., i.e. an average grain area of 0.0200 sq.mm. or less.

Alloy 6061 ingot was obtained of the following composition which is typical of the composition used for seamless tube, composition wt-% Si 0.59, Fe 0.23, Cu 0.36, Mn 0.01, Mg 0.96, Cr 0.05, Ni 0.00, Zn 0.01, Ti 0.01, remainder Al. The following three-step PSN treatment was applied on a lab scale:

1. Soak 4 hours at 1050° F.
2. Cool to 700° F. at 25° F./hour.
3. Hold 8 hours at 700° F., followed by ambient air cool to room temperature.

FIGS. 1 to 4 illustrate various stages of this treatment.

FIG. 1 (Sample No. 555096-1, Neg. No. 328675, as-polished) shows the microstructure of as-cast, 6061 ingot. Second phase constituent particles are the insoluble Al-Fe-Si phases (light color) and the soluble $Mg_2Si$ phase (dark color) is located at the dendrite cell boundaries and interstices.

Figure 2:
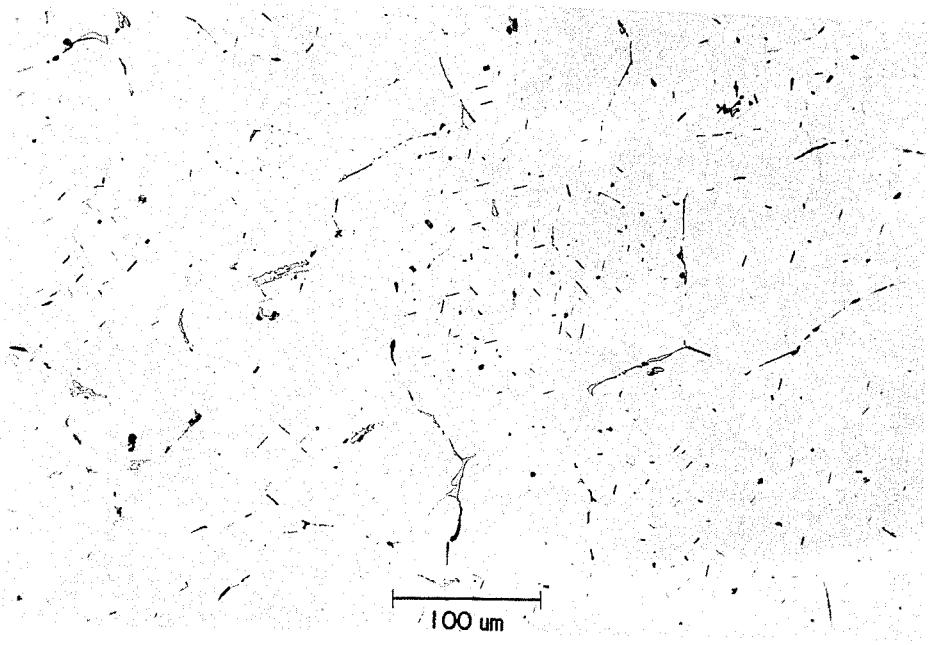

FIG. 2 (Sample No. 555097-1, Neg. No. 328676, as-polished) shows standard preheated 6061 ingot. Typical preheat is 4 to 5 hours at 1030°–1050° F. followed by ambient air cool to room temperature. The second phase constituent particles at the cell boundaries now are principally the insoluble Al-Fe-Si phases. The $Mg_2Si$ was dissolved during the preheat but precipitated as fine, randomly distributed particles during the slow cool. These particles are too small to effectively stimulate recrystallization during extrusion; hence, the grain size will be determined by the insoluble consitutents at the cell boundaries.

Figure 3:
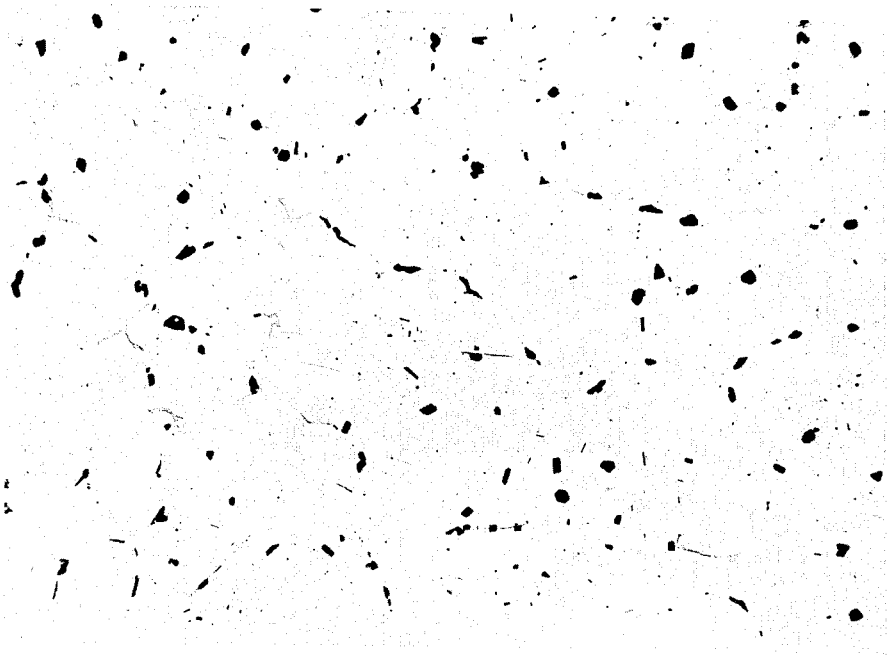

FIG. 3 (Sample No. 555096-S, Neg. No. 329058A, as-polished) shows the as-cast 6061 ingot after it was given a PSN treatment consisting of: (a) 4 hours at 1050° F., (b) 25° F./hr cool to 700° F., (c) 8 hours at 700° F., followed by ambient air cool to room temperature. The $Mg_2Si$ originally at the cell boundaries was dissolved at 1050° F. and then precipitated and grew to a large (5–20 μm) size during the controlled cool to, and long soak at, 700° F. The fine background precipitates probably occurred during the cool to room temperature from 700° F. Recrystallization during extrusion should now be stimulated by the large $Mg_2Si$ particles as well as the insoluble Al-Fe-Si constituents.

Figure 4:
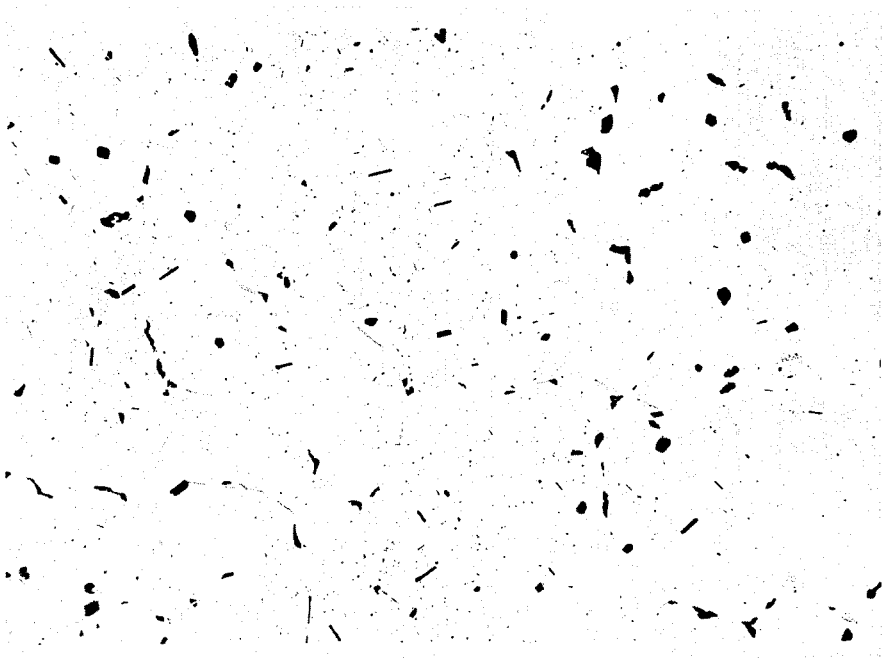

FIG. 4 (Sample No. 555097-S, Neg. No. 329059A, as-polished) shows the standard preheated 6061 ingot after it was given the PSN treatment of the preceding paragraph. Note that step (a) of the PSN treatment essentially repeats the standard preheat already given the ingot. It is desirable to make this repeat, in order to secure the beneficial effect of the controlled cool to 700° F. for producing large $Mg_2Si$ particles. The resulting microstructure is essentially the same as that shown in FIG. 3. From a practical standpoint the PSN treatment would be applied to as-cast ingot because of the comparability of the first step (a) to the standard preheat soak. However, if available ingots already have been given a standard preheat, they still will respond to a PSN treatment.

This treatment was applied in a production furnace with an increased hold time of 12 hours at 700° F. to give more time for the particles to grow. Again the desired microstructure was obtained.

In a second, production scale trial with 6061 aluminum alloy of composition as follows: wt-% Si 0.62, Fe 0.28, Cu 0.33, Mn 0.02, Mg 0.94, Cr 0.06, Ni 0.003, Zn 0.04, Ti 0.02, remainder Al, cooling to 700° F. was faster, 55° F./hr., and an even more favorable microstructure with less fine background precipitates was obtained.

Ingot from this second trial was extruded into tube and the desired finer grain size and improved bendability was obtained with no loss in strength. Results are presented Table I and FIGS. 5 to 8.

TABLE I

EFFECT OF THE TYPE OF PREHEAT AND AMOUNT OF REHEAT ON THE TENSILE PROPERTIES, GRAIN SIZE, AND BENDABILITY OF MID-LENGTH SAMPLES OF 6061-T6 EXTRUDED 13" O.D. By 0.540" WALL TUBE

| | | | Longitudinal Tensile Properties | | | | Grain Count at | 180° Bend Tests | |
|---|---|---|---|---|---|---|---|---|---|
| S. No. | Type of Preheat(1) | Reheat, Min/°F. | T.S., ksi | Y.S., ksi | El., % | R. of A % | O.D. Surface - No. Grains/Sq. mm(4) | % Strain(2) | Predicted MBR(3) |
| 558681 | PSN | 10/742 | 49.4 | 43.2 | 19.0 | 28 | 167 | 14 | 2.75 |
| 558682 | PSN | 30/733 | 49.2 | 43.1 | 18.0 | 27 | 178 | 15 | 2.60 |
| 558683 | PSN | 44/746 | 48.7 | 42.7 | 18.0 | 33 | 110 | 14 | 2.75 |
| 558684 | PSN | 60/766 | 48.2 | 42.0 | 19.0 | 36 | 76 | 12 | 3.25 |
| 558685 | PSN | 15/822 | 48.9 | 42.9 | 17.5 | 26 | 85 | 14 | 2.75 |
| 558686 | PSN | 28/838 | 49.0 | 43.0 | 18.0 | 26 | 88 | 16 | 2.50 |
| 558687 | PSN | 45/850 | 48.0 | 42.0 | 15.0 | 26 | 113 | 14 | 2.75 |
| 558688 | PSN | 55/852 | 47.3 | 41.5 | 15.5 | 26 | 46 | 11 | 3.50 |
| 558689 | PSN | 18/955 | 48.3 | 41.4 | 17.0 | 31 | 56 | 12 | 3.25 |
| 558690 | PSN | 32/948 | 48.5 | 42.1 | 16.0 | 26 | 32 | 9 | 4.00 |
| 558691 | PSN | 48/936 | 49.1 | 43.1 | 16.0 | 30 | 51 | 9 | 4.00 |
| 558692 | PSN | 56/957 | 49.1 | 42.8 | 13.5 | 23 | 71 | 14 | 2.75 |
| 558693 | Std. | 14/970 | 49.5 | 42.8 | 17.0 | 19 | 34 | 9 | 4.00 |
| 558694 | Std. | 50/978 | 50.5 | 44.3 | 16.0 | 19 | 41 | 11 | 3.50 |

NOTES:
(1)PSN = Three step particle-stimulated nucleation preheat; Std. = standard one step preheat.
(2)Measured maximum % strain developed on O.D. surface prior to onset of a surface fracture.
(3)Minimum bend radius corresponding to measured strain predicted by formula that relates bend radius to % strain. Units are in inches, being the indicated number multiplied by the thickness of the tube wall.
(4)The grain count is the measured metallographic parameter, but the inverse of this number can be used to describe an average grain area in sq. mm.

Figure 5:
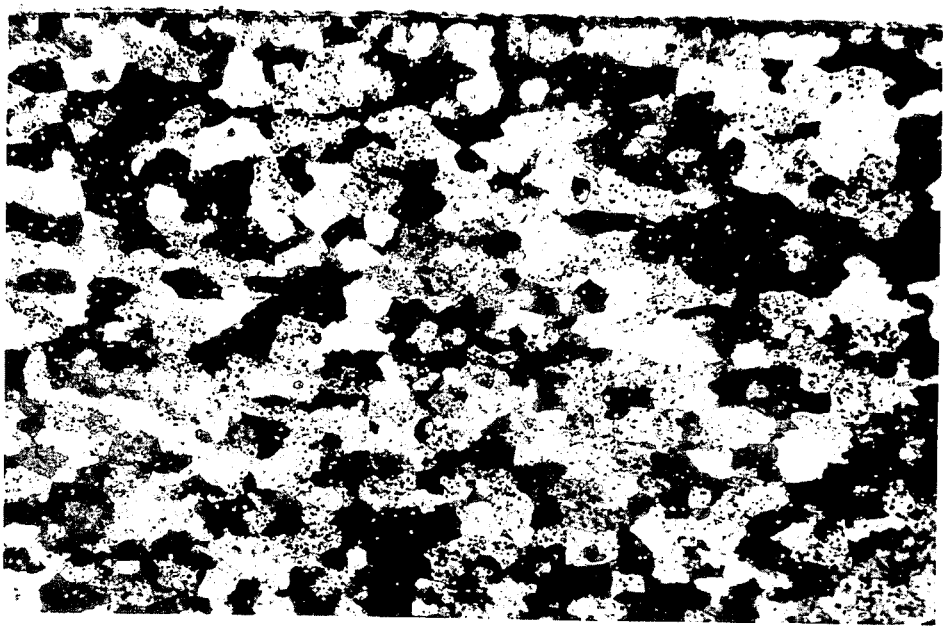

FIG. 5 (Sample No. 558681-1, Neg. No. 329965, electropolished, and polarized light) shows a longitudinal surface section of the 6061 extruded tube (F temper) from the PSN preheated billet reheated 10 minutes at 742° F. Average grain count at the surface of this specimen was 167 grains/mm$^2$, average grain area 0.0060 sq.mm. (ASTM grain size 5.) This grain size is much finer than that of the extruded tube from conventionally preheated ingot shown in FIG. 8.

Figure 6:
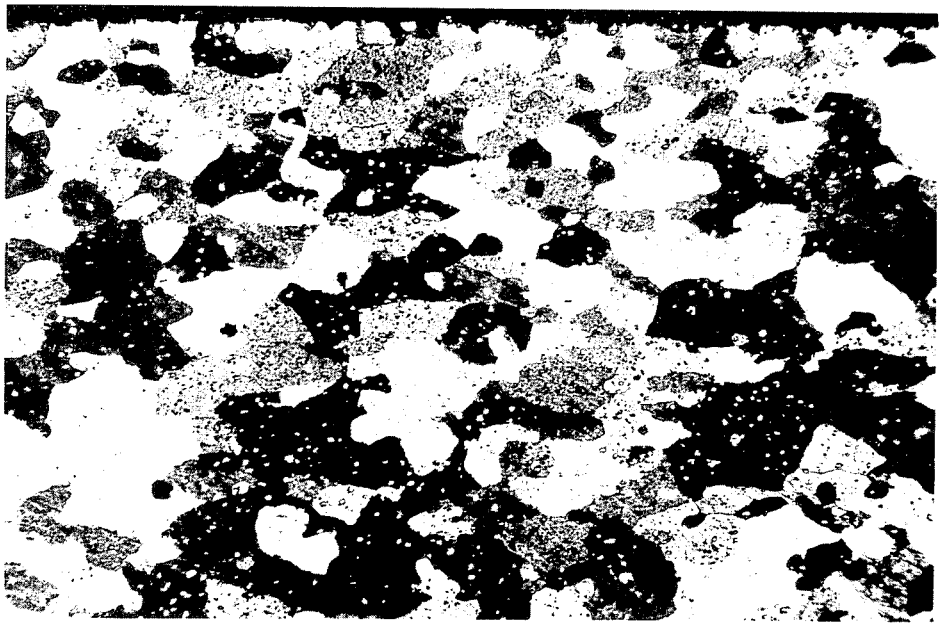

FIG. 6 (Sample No. 558685-1, Neg. No. 329966, electropolished, and polarized light) shows a longitudinal surface section of the extruded tube (F temper) from the PSN preheated billet reheated 15 minutes at 822° F. Average grain count at the surface of this specimen was 85 grains/mm$^2$, average grain area 0.0118 sq.mm. (ASTM grain size 3.) Note the increase in grain size over that shown in FIG. 5, but the size still is considerably smaller than in the control, FIG. 8.

Figure 7:
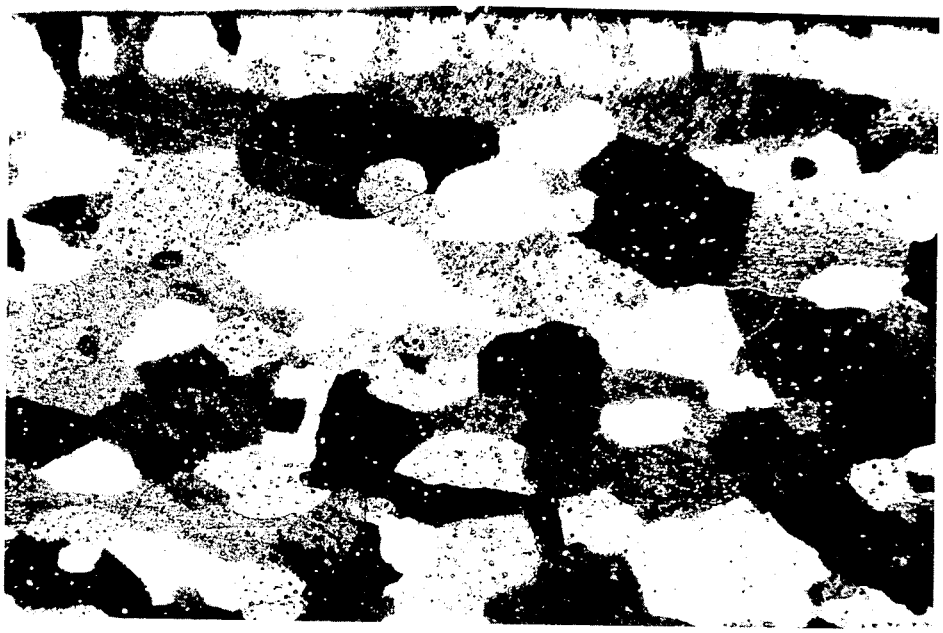

FIG. 7 (Sample No. 558689-1, Neg. No. 329967, electropolished, and polarized light) shows a longitudinal surface section of the 6061 extruded tube (F temper) from the PSN preheated billet reheated 18 minutes at 955° F. Average grain count at the surface of this specimen was 56 grains/mm$^2$, average grain area 0.0179 sq.mm. (ASTM grain size 3.) The grain size is only slightly smaller than the control, FIG. 8.

Figure 8:
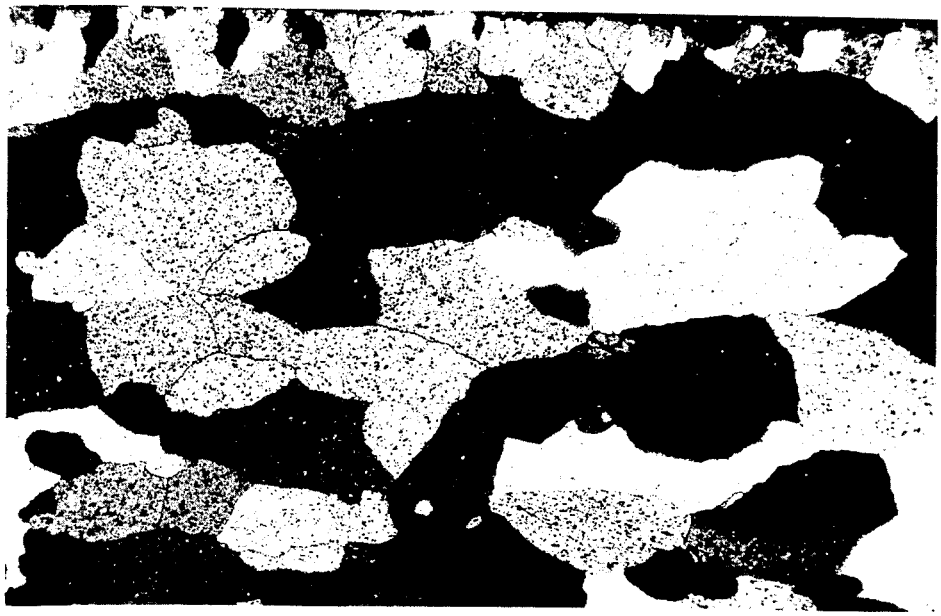

FIG. 8 (Sample No. 558694-1, Neg. No. 329968, electropolished, and polarized light) shows longitudinal surface section of the 6061 extruded tube (F temper) from the standard preheated billet reheated 50 minutes at 978° F. Average grain count at the surface of this specimen was 41 grains/mm$^2$, average grain area 0.0244 sq.mm. (ASTM grain size 2.) The other control reheated 14 minutes at 970° F. was similar with just slightly larger grains, average surface grain count of 34 grains/mm$^2$, average grain area 0.0294 sq.mm. Previous examinations of extruded tube from conventionally preheated ingot showed grains of about this size or slightly larger.

Subsequent to extrusion, the tubes were solution heat treated in the range 975° to 1045° F. and precipitation hardened to the T6 condition.

Studies with 6061 aluminum alloy of composition wt-%, Si 0.62, Fe 0.23, Cu 0.37, Mn 0.02, Mg 0.99, Cr 0.05, Zn 0.09, Ti 0.02, remainder Al, have been run to determine the degree of reheating that can be given to a PSN preheated billet and still obtain a relatively fine, recrystallized grain structure in the final extrusion. Results indicate 800° to 850° F. as the most favorable temperature range, with 650° to 900° F. as the overall usable range. Reheating in the temperature range of 800° to 850° F. appears to be the optimum because this dissolves much of the fine precipitation without causing undue dissolution of the large particles that stimulate recrystallization. Reheat temperatures in excess of 900° F. and below 650° F. reduced the effectiveness of the PSN process. Temperatures in excess of 900° F. lead to undue dissolution of the large particles; a test at 550° F. showed unfavorable increase in the amount of fine precipitates.

For the 650° to 900° F. temperature range, soak times from 15 to 60 minutes were studied. Soak times as long as 45 minutes had no appreciable adverse effect and even 60 minutes seems tolerable at 650° to 750° F.

EXAMPLE 2

Other 6XXX Aluminum Alloys

It is expected that the invention's chemical composition controls and the PSN thermal treatment developed on alloy 6061 are directly applicable to other 6XXX alloy ingot. Notable commercial alloys are: 6009, 6010, X6013, 6063 and 6351. More stringent control of the reheat time and temperature will be required for the more dilute alloys.

EXAMPLE 3

2XXX and 7XXX Aluminum Alloys

With compositional and thermal modifications as described below, the PSN concept should be applicable to 2XXX and 7XXX alloy ingots.

Compositional modification involves minimizing the dispersoid forming elements so as to promote recrystallization. Some experimentation may be necessary to establish how low the dispersoid level can be reduced and still maintain other desired characteristics of the particular alloy. For example, it is known that a Cr free version of 7075 alloy responds differently to T7 type agings than does 7075 alloy with the normal 0.18 to 0.28 wt-% Cr.

Thermal modification involves selection of appropriate temperatures for the first and third steps of the PSN preheat. A high temperature is required in the first step to dissolve all or most of the soluble alloying elements without causing melting. In the third step, a lower temperature is required at which the solubility is less than the alloy content. Soaking at this temperature then precipitates the large particle sizes needed to stimulate recrystallization. One skilled in the art can develop these two temperatures from the solvus and solidus temperatures in the phase diagrams of the alloy systems of interest.

The reheat temperature for the deformation process would have to be kept low for 7XXX alloys because of the lower solvus temperatures for this alloy system.

For any given alloy, the allowable ranges and optimum practice can be established without undue experimentation, particularly for the following production steps:

1. The cooling rate from the initial preheat temperature.
2. The temperature and soak time to grow the desired particle size.
3. The allowable time and temperature of the reheat to extrude practice.

Note that the reheat practice cannot be too long at a temperature above the soaking temperature used to grow the particles because this will begin to redissolve the particles. Temperatures reached during the actual extrusion process probably are not critical because the time of the actual extrusion is short, typically 2 to 6 minutes.

The actual extrusion parameters, e.g. type of extrusion press, billet container temperature, extrusion pressure and extrusion speed, will be dictated by the particular shape being produced. No special extrusion procedures are employed other than to minimize transfer time of the billet from the reheat furnace into the billet container to avoid undue cooling of the billet.

The seamless 6061 alloy tubing in Example 1 had an outside diameter of 13 inches and a wall thickness of 0.54 inch. It was extruded from 25 inch O.D. by 12.5 inch I.D. by 42 inch long hollow billets that were individually reheated in an induction furnace. The tube was extruded at a speed of 20 to 23 fpm using a 14,000 ton, direct extrusion press with the container heated to 800° F. For thinner shapes, extrusion speeds can rise to 60–80 fpm. Transfer times from the reheat furnace to the billet container ranged from 1 to 4 minutes. During this transfer, billets heated to 750° F. and 850° F., cooled 2° to 8° F., while billets heated to 950° F., cooled 12° to 14° F.

A temperature rise occurs during the extrusion-deformation process, but temperature conditions within the press could not be monitored. Temperature measurements were made at the mid-length of the exiting tube. Calculations of probable heat loss to the surrounding 90° F. air indicated the temperatures of metal exiting the die had risen approximately 150° F. for billet reheated to 750° F., approximately 100° F. for billet reheated to 850° F. and approximately 65° F. for billets reheated to 950° F.

After extrusion, the tube was allowed to cool in air to room temperature. Samples then were cut for metallographic determination of grain size in the as-extruded F temper. A portion of each sample was given a standard 1.5 hour solution heat treatment at 985° F. and a recheck of the grain size showed no significant change resulted from the heat treatment.

It is interesting to note that Schneck, above-cited, used a precipitate developing treatment at first glance resembling our PSN treatment. Thus, the Schneck patent, supra, teaches a soak between 700° and 750° F. for 2 to 10 hours. However, he stresses that he obtained substantially no recrystallization. We believe his results are attributable to the presence of alloying elements intended to suppress recrystallization and his lower solution heat treat range of 900° to 925° F. In contrast, we prefer an Al-Mg-Si aluminum alloy with a low content of dispersoid forming elements i.e. $Cr \leqq 0.10\%$; $Zr \leqq 0.05\%$ and $Mn \leqq 0.10\%$, together with solution heat treatment at the normal 975° to 1045° F. temperature range.

What is claimed is:

1. A method comprising providing aluminum in the form of Al-Mg-Si alloy having $Mg_2Si$ particles for stimulating nucleation of new grains, and deforming the aluminum under conditions for causing recrystallization to occur during deformation or thereafter, without subsequent heating being required to effect recrystallization, the total content of dispersoid forming elements Cr, Mn and Zr being at a level permitting such recrystallization to occur, the recrystallized aluminum having an average grain count of greater than 41 grains/$mm^2$.

2. A method as claimed in claim 1, wherein the deforming comprises extruding.

3. A method as claimed in claim 2, wherein the aluminum supplied to the extruding is in ingot form.

4. A method as claimed in claim 2, wherein the aluminum is an Al-Mg-Si alloy preheated in the temperature range 980° F. to 1080° F. for the time range ½ to 10 hours, then soaked in a temperature range 600° F. to 800° F. for a time range 5 to 24 hours to develop $Mg_2Si$ phase for PSN.

5. A method as claimed in claim 4, wherein the aluminum is cooled from preheat to the $Mg_2Si$ development soak at a rate of 15° F./hr. to 70° F./hr.

6. A method as claimed in claim 4, wherein the aluminum is reheated at a temperature range 650° to 900° F. for a time range 15 to 60 minutes and then extruded.

7. A method as claimed in claim 6, wherein the aluminum is reheated at a temperature range 800° to 850° F.

8. A method as claimed in claim 4, wherein the Al-Mg-Si aluminum alloy composition is controlled as follows: wt-% $Cr \leqq 0.15$, $Mn \leqq 0.10$, and $Zr \leqq 0.10$.

9. A method as claimed in claim 8, wherein the Al-Mg-Si aluminum alloy composition is controlled as follows: wt-% $Cr \leqq 0.10$, $Mn \leqq 0.05$ and $Zr \leqq 0.05$.

10. A method as claimed in claim 4, wherein following extrusion, the aluminum is solution heat treated in the temperature range 975° to 1045° F.

11. A method as claimed in claim 1, wherein the recrystallized aluminum has an average grain count of at least 56 grains/$mm^2$.

12. A method as claimed in claim 11, wherein the recrystallized aluminum has an average grain count of at least 85 grains/$mm^2$.

13. A method as claimed in claim 12, wherein the recrystallized aluminum has an average grain count of at least 167 grains/$mm^2$.

14. A method as claimed in claim 1, said alloy being aluminum alloy 6061.

15. A method as claimed in claim 9, wherein the alloy is aluminum alloy 6061 of about the following composition in wt-%: Si 0.59, Fe 0.23, Cu 0.36, Mn 0.01, Mg 0.96, Or 0.05, Ni 0.00, Zn 0.01, Ti 0.01, remainder Al.

16. A method as claimed in claim 9, wherein the alloy is aluminum alloy 6061 of about the following composition in wt-%: Si 0.62, Fe 0.28, Cu 0.33, Mn 0.02, Mg 0.94, Cr 0.06, Ni 0.003, Zn 0.04, Ti 0.02, remainder Al.

17. A method as claimed in claim 2, seamless extruded tube for cylinders for compressed gases being formed in the step of extruding.

18. A method as claimed in claim 1, the total content of dispersoid forming elements being below 0.15 wt-%.

19. A method as claimed in claim 1, the total content of dispersoid forming elements being below 0.10 wt-%.

20. A method comprising providing precipitation hardening aluminum alloy having particles for stimulating nucleation of new grains, said particles being the equilibrium phase of particles which effect precipitation hardening, and deforming the aluminum under conditions for causing recrystallization to occur during deformation or thereafter, without subsequent heating being required to effect recrystallization, the total content of dispersoid forming elements Cr, Mn and Zr being at a level permitting such recrystallization to occur, the recrystallized aluminum having an average grain count of greater than 41 grains/$mm^2$.

21. A method as claimed in claim 20, the aluminum being an aluminum alloy selected from the group consisting of the 2XXX and 7XXX aluminum alloys.

* * * * *

UNITED STATES PATENT AND TRADEMARK OFFICE

CERTIFICATE OF CORRECTION

PATENT NO. : 4,659,396

DATED : April 21, 1987

INVENTOR(S) : Bernard W. Lifka, John Liu, Roger D. Doherty

It is certified that error appears in the above-identified patent and that said Letters Patent is hereby corrected as shown below:

Claim 15,
Col. 8, line 15 Change "Or" to --Cr--.

Signed and Sealed this

Twenty-second Day of September, 1987

*Attest:*

DONALD J. QUIGG

*Attesting Officer* *Commissioner of Patents and Trademarks*